US007034793B2

(12) United States Patent
Sekiya et al.

(10) Patent No.: US 7,034,793 B2
(45) **Date of Patent: *Apr. 25, 2006**

(54) LIQUID CRYSTAL DISPLAY DEVICE

(75) Inventors: Kazuo Sekiya, Tokyo-to (JP); Hajime Nakamura, Yokohama (JP)

(73) Assignee: AU Optronics Corporation, (TW)

( * ) Notice: Subject to any disclaimer, the term of this patent is extended or adjusted under 35 U.S.C. 154(b) by 163 days.

This patent is subject to a terminal disclaimer.

(21) Appl. No.: 10/063,918

(22) Filed: May 23, 2002

(65) Prior Publication Data

US 2002/0175907 A1 Nov. 28, 2002

(30) Foreign Application Priority Data

May 23, 2001 (JP) ..... 2001-154531

(51) Int. Cl.
*G09G 3/36* (2006.01)

(52) U.S. Cl. ..... 345/98; 345/99

(58) Field of Classification Search ..... 345/87–104, 345/204–214

See application file for complete search history.

(56) References Cited

U.S. PATENT DOCUMENTS 5,495,265 A * 2/1996 Hartman et al. ..... 345/87
6,304,254 B1 * 10/2001 Johnson et al. ..... 345/204

FOREIGN PATENT DOCUMENTS

JP 04-365094 A 12/1992
JP 07-020828 A 1/1995
JP 07-056532 A 3/1995
JP 07-121138 A 5/1995
JP 09-106262 A 4/1997
JP 11-219153 A 8/1999
JP 11-326868 A 11/1999
JP 11-326957 A 11/1999
JP 2000-231091 A 8/2000

OTHER PUBLICATIONS

Y. Takubo (Matsushita) et al., "Response time improvement of TFT-LCDs by using capacitively coupled driving", AMLCD '95, session A4-5, pp 59-62.
K. Nakao (Matsushita) et al., "Response time improvement of OCB mode TFT-LCDs by using capacitively coupled driving method", IDW '00, session AMD4-3, pp 215-218.
B.G. Rho (Korea national semiconductor) et al., "A new driving method for faster response of TFT LCD on the basis of equilibrium charge injection", IDW '00, session AMDp-9, pp. 1155-1156.

(Continued)

*Primary Examiner*—Kent Chang
(74) *Attorney, Agent, or Firm*—Scully, Scott, Murphy & Presser, P.C.

(57) ABSTRACT

A liquid crystal display drive circuit includes capacitance predicting section for predicting a capacitance value each pixel will reach at one refresh cycle later when applying a predetermined voltage for targeted brightness, a frame buffer for storing the predicted capacitance value, and overdrive voltage calculating section for calculating a voltage to be applied to each pixel based on targeted brightness at one refresh cycle later and the stored capacitance value in frame buffer.

18 Claims, 7 Drawing Sheets

OTHER PUBLICATIONS

Baek-woon Lee (Samsung) et al., "TFT-LCD with sub-10ms of all gray response time: dynamic capacitance compensation", IDW '00, session AMD4-5, pp1153-1154.

H. Nakamura (IBM) et al., "Computational optimization of active-matrix drives for liquid crystal displays", IDW '00, session LCT4-4, pp81-84.

* cited by examiner

| | Target level | level 0 | level 1 | level 2 | level 3 | level 4 | level 5 | level 6 | level 7 | level 8 |
|---|---|---|---|---|---|---|---|---|---|---|
| Static start level | Targeted brightness \ Starting capacitance | 0.00084 | 0.01030 | 0.04735 | 0.11549 | 0.21812 | 0.35558 | 0.53084 | 0.74584 | 0.99995 |
| level 8 | 5.5530 | 7.9969 | 6.2088 | 5.3633 | 4.7434 | 4.3583 | 4.0163 | 3.7284 | 3.3490 | 1 |
| 1.2V | 5.5836 | 7.9853 | 6.1556 | 5.3011 | 4.6908 | 4.3083 | 3.9580 | 3.6612 | 3.2703 | 1.5190 |
| 1.4V | 5.6605 | 7.9546 | 6.0393 | 5.1786 | 4.5898 | 4.2147 | 3.8688 | 3.5410 | 3.1543 | 1.1244 |
| 1.6V | 5.8939 | 7.8537 | 5.9457 | 4.9601 | 4.4310 | 4.0057 | 3.6906 | 3.3380 | 2.9389 | 1.0166 |
| 2.0V | 7.2035 | 6.9652 | 5.3997 | 4.3980 | 3.8826 | 3.4630 | 3.1309 | 2.7736 | 2.3330 | 0 |
| level 7 | 7.8413 | 6.7616 | 4.9793 | 4.1777 | 3.6770 | 3.2896 | 2.9263 | 2.5856 | 2.158 | 0 |
| level 6 | 8.5975 | 6.3884 | 4.7512 | 3.9271 | 3.4393 | 3.0596 | 2.7401 | 2.385 | 1.9596 | 0 |
| level 5 | 9.1804 | 5.9943 | 4.4998 | 3.7848 | 3.3111 | 2.9200 | 2.579 | 2.2487 | 1.7995 | 0 |
| level 4 | 9.6941 | 5.9067 | 4.3949 | 3.6299 | 3.1811 | 2.782 | 2.4674 | 2.1403 | 1.6869 | 0 |
| level 3 | 10.1912 | 5.7948 | 4.2666 | 3.4791 | 3.023 | 2.7102 | 2.3720 | 2.0355 | 1.5911 | 0 |
| level 2 | 10.7078 | 5.6447 | 4.0978 | 3.346 | 2.9358 | 2.5869 | 2.2742 | 1.9221 | 1.4946 | 0 |
| level 1 | 11.3424 | 5.4002 | 3.907 | 3.2696 | 2.8290 | 2.4518 | 2.1494 | 1.7938 | 1.3155 | 0 |
| level 0 | 12.1062 | 5 | 3.8051 | 3.0822 | 2.6795 | 2.3293 | 1.9869 | 1.6461 | 1.1323 | 0 |

Fig. 6

| Applied voltage / Starting capacitance | 0 | 1 | 2 | 2.5 | 3 | 4 | 5 | 6 | 7 | 8 |
|---|---|---|---|---|---|---|---|---|---|---|
| 5.52 | 5.52 | 5.54 | 5.66 | 5.96 | 6.74 | 9.23 | 10.62 | 11.33 | 11.78 | 12.11 |
| 5.55 | 5.53 | 5.55 | 5.74 | 6.14 | 7.05 | 9.39 | 10.66 | 11.34 | 11.79 | 12.12 |
| 6.45 | 5.70 | 5.85 | 6.72 | 7.62 | 8.60 | 10.12 | 11.02 | 11.59 | 11.99 | 12.30 |
| 7.84 | 5.93 | 6.24 | 7.53 | 8.48 | 9.36 | 10.62 | 11.38 | 11.88 | 12.25 | 12.53 |
| 8.60 | 6.05 | 6.42 | 7.86 | 8.81 | 9.65 | 10.83 | 11.54 | 12.02 | 12.37 | 12.64 |
| 9.69 | 6.22 | 6.69 | 8.29 | 9.23 | 10.02 | 11.09 | 11.75 | 12.19 | 12.52 | 12.78 |
| 10.71 | 6.38 | 6.94 | 8.65 | 9.56 | 10.30 | 11.30 | 11.91 | 12.33 | 12.65 | 12.89 |
| 11.74 | 6.59 | 7.22 | 8.98 | 9.85 | 10.55 | 11.48 | 12.06 | 12.46 | 12.76 | 12.99 |
| 12.11 | 6.67 | 7.33 | 9.09 | 9.94 | 10.62 | 11.54 | 12.11 | 12.50 | 12.80 | 13.02 |
| 13.54 | 7.04 | 7.74 | 9.45 | 10.25 | 10.88 | 11.73 | 12.26 | 12.64 | 12.91 | 13.13 |

Fig. 7

LIQUID CRYSTAL DISPLAY DEVICE

BACKGROUND OF INVENTION

1. Field to the Invention

The present invention relates to a liquid crystal display device, and more particularly to a liquid crystal display device for improving the response time of the liquid crystal display.

2. Background of the Invention

Recently, a liquid crystal display (LCD) equipped with thin film transistors (TFT) has developed significantly due to its characteristics including light weight, thin shape and low power consumption. Conventionally, the use of LCDs for PCs was mainly directed to displaying static images, however, along with the progress of such LCDs, they have been substituted for CRTs such as when displaying moving pictures in a graphics system or displaying video images on monitors. Therefore, there is growing interest in displaying moving pictures using LCDs.

While a CRT is in the impulse type of light emission, an LCD is in the hold type with emitting continuous light during a whole period of a frame, thereby being unable to follow the CRT in terms of a quality of moving pictures if leaving them as they are. Accordingly, there have been proposed, for example, a scheme for doubling the refresh rate or the blanking scheme for emitting light intermittently for each frame in order to obtain the similar characteristics to CRT for moving pictures. This is an ideal solution but requires a special liquid crystal with a very fast response, so that the liquid crystals currently in use are not applicable due to their slow response.

For example, a present TN mode TFT-LCD has its on/off response time equivalent to about 1 refresh cycle (16.7 ms at 60 Hz refresh), however, the response time delays greatly in a halftone level, resulting in up to several to ten refreshes. In particular, video images such as TV images mostly have halftone images, so that correct brightness can not be obtained. Even when displaying text data on PCs, it takes a long time for a screen to become a good state where one can easily read if he performs a scroll operation.

As above, a deterioration in image quality when displaying moving pictures on a TFT-LCD results from that a transition of brightness of each pixel does not complete within one frame period of 16.7 ms. Namely, even in the case of liquid crystals with a fast response, the capacitance of the liquid crystal changes in principle of the liquid crystal driving, wherein the targeted brightness can not be reached only by one time of charge/discharge of TFT as long as using the normal driving method, as a matter of course, resulting in the display response being unable to catch up with the image when it changes for each frame. Furthermore, since the response time differs between R, G and B for displaying color images because the response time varies depending on gray levels, a color shift (hue change) may occur in boundary areas of moving edges or thin lines.

There exists a method called overdrive for resolving the delay of the response time. This method is to improve the response characteristics to a step input for the liquid crystal device by applying a voltage greater or smaller than the targeted voltage at the first frame of input changes. For example, Japanese Unexamined Patent Publication No. 1995-20828 discloses a technique that attempts to reproduce faithful brightness with hysteresis and afterimage characteristics being improved even for moving pictures or TV images accompanying active changes by processing input image signals so as to compensate the response characteristics of transmittance against a voltage applied to the liquid crystal, considering a predicted value of voltage response characteristics of the liquid crystal.

The overdrive technique is relatively easily implemented only by changing the driving method and needs no change of a liquid crystal device itself, which is otherwise bothersome. In addition, it is also possible to combine with other techniques for improvement. However, the conventional overdrive techniques including the above publication may simply use a simple voltage value as a parameter. Since the voltage value, when not reaching the equilibrium state, takes the same value for a variety of gray levels of brightness or internal states, it is inappropriate as a parameter for determining a next overdrive voltage.

Furthermore, since the charge is completely discharged in a transition to a full-OFF state, i.e., 0V, there exists no "cumulative response" component, which asymptotically approaches to the targeted gray level as a result of the accumulation of the applied voltage over multiple frames. It is noted that liquid crystals are a viscous fluid and have a slow displacement speed per se, thus this would be regarded as the only cause of slow response time, however, a predicted voltage is 0V insofar as prediction so that it is impossible to represent the process of transition by means of voltage. Though the publication cited above describes about using a low pass filter (LPF) to represent the process of transition in a pseudo manner, a peculiar low pass filter that is different from the one for other gray levels must be provided since the cumulative response does not exist during a full-OFF transition. Furthermore, since the "cumulative response" and "viscosity" are nonlinear over the all gray levels, it is difficult indeed to get the necessary predicted values using the LPF.

SUMMARY OF INVENTION

In view of the above technical problems, it is a feature of the present invention to improve scrolling of text, dragging of icons, computer graphics (CG) animation displayed on LCDs, as well as color shifts, blurring and trailing that may appear on moving pictures.

It is another feature of the invention to bring the pixel brightness close to a targeted value within a single refresh cycle time when the gray level displayed changes, for example.

A liquid crystal display device according to the invention includes a liquid crystal cell such as a TFT-LCD forming an image display area, and a driver applying a voltage to the liquid crystal cell, and an overdrive controller controlling the driver to apply an overdrive voltage that exceeds a targeted pixel value to the liquid crystal cell. The overdrive controller stores a predicted capacitance value of each pixel and interpolates the information about the voltage value stored in the memory based on the predicted capacitance value to calculate the overdrive voltage.

In a yet further aspect of the present invention, there is provided a method for driving a liquid crystal display, wherein an input pixel value is overdriven to output a modified pixel value. The method includes the steps of: predicting a capacitance value where each pixel will reach at one refresh cycle later when applying a predetermined voltage for the input pixel value; storing the predicted capacitance value; and calculating an overdrive voltage to be applied to each pixel based on an input pixel value at one refresh cycle later and the stored capacitance value.

In a still further aspect of the present invention, there is provided a method for driving a liquid crystal display wherein a brightness change delays relative to a capacitance change, the method comprising the steps of: predicting a capacitance value of each pixel of the liquid crystal display when applying a predetermined voltage; calculating a voltage exceeding the targeted pixel value based on an input targeted pixel value with using the predicted capacitance value as a parameter; and supplying a predetermined voltage to the liquid crystal display based on the calculated voltage.

Various other objects, features, and attendant advantages of the present invention will become more fully appreciated as the same becomes better understood when considered in conjunction with the accompanying drawings, in which like reference characters designated the same or similar parts throughout the several views.

BRIEF DESCRIPTION OF DRAWINGS

FIG. 6 is a table associated with a TN mode liquid crystal with 5 μm gap and depicting values used to obtain an overdrive voltage to be applied this time based on the present capacitance value obtained from simulation.

FIG. 7 is a table used to calculate a capacitance value at one frame period later for a pixel with a certain capacitance value.

DETAILED DESCRIPTION

Figure 1:
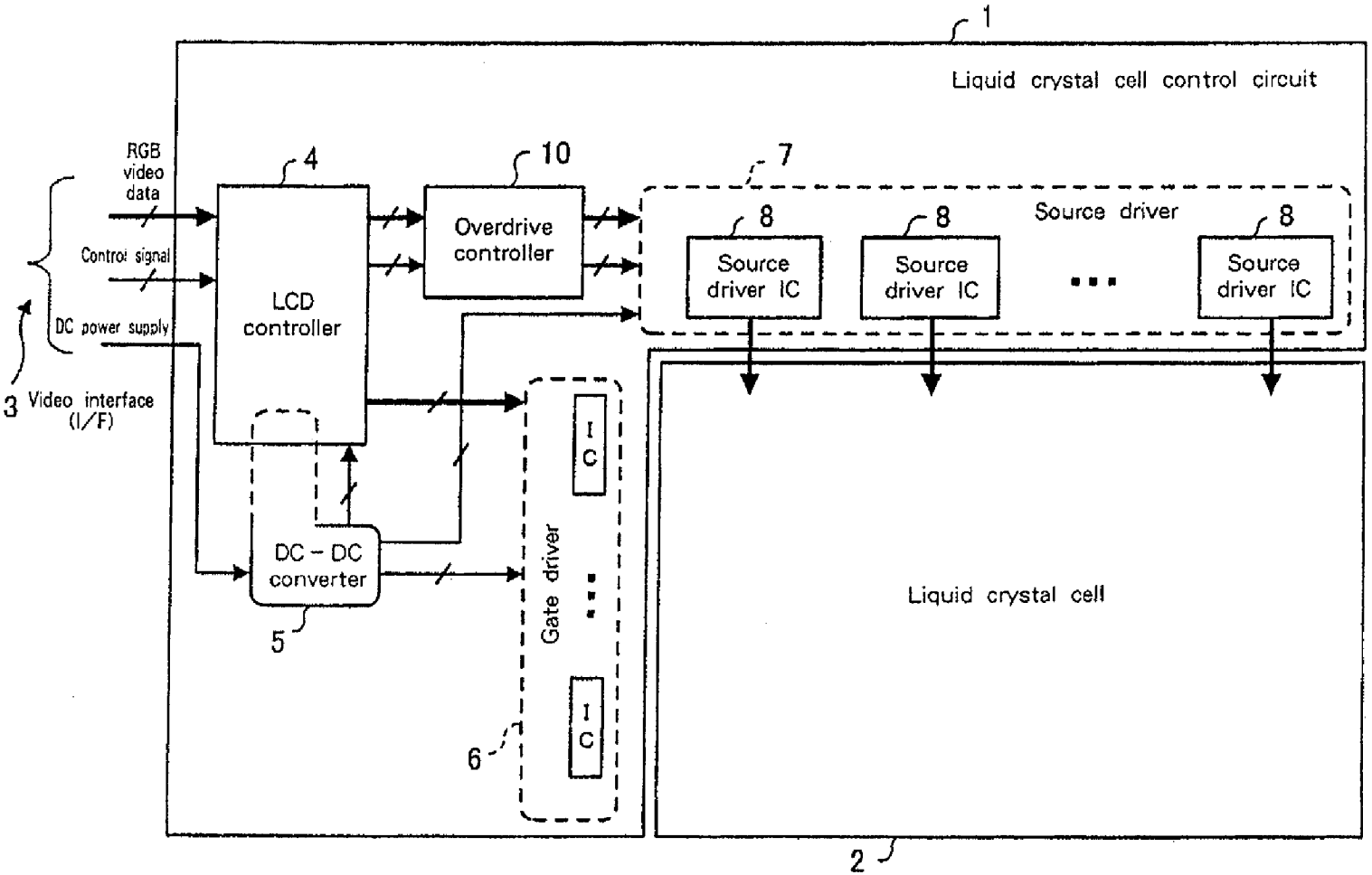
FIG. 1 is a schematic diagram of an embodiment of a liquid crystal display (LCD) device according to the present invention.

In order to achieve the above purposes, according to the present invention, when the gray level displayed changes for each pixel of a TFT-LCD, an excessive voltage (i.e., overdrive voltage) exceeding a targeted pixel value is applied with respect to a varied amount of the refresh cycle such that the brightness of a pixel reaches the targeted value within one refresh cycle time. In this regard, it is characterized in that a starting value for calculating the applied voltage is based on the capacitance of each pixel.

In another aspect of the present invention, there is provided a controller for a liquid crystal display device, comprising: voltage calculating means for calculating a voltage to be applied to a liquid crystal cell based on targeted brightness at one refresh cycle later corresponding to a pixel value to be displayed this time and a present capacitance value of the pixel that is predicted in advance; capacitance predicting means for predicting a capacitance value of the pixel that will be reached after the refresh cycle when applying the voltage calculated by the voltage calculating means to the pixel with the present capacitance value; and storage means for storing the capacitance value predicted by the capacitance predicting means, wherein the voltage to be applied is calculated and the capacitance value is predicted, respectively, based on the capacitance value stored in the storage means.

The liquid crystal display device may further comprise a memory storing information used to obtain a voltage to be applied this time from a present capacitance value and information about a capacitance value where a pixel will reach when applying a predetermined voltage to the pixel with a predetermined capacitance value, wherein the voltage to be applied and the predicted capacitance are easily determined using a simple configuration. Information stored in the memory may include discrete values in tabular form obtained by the simulation, for example, or may be values obtained based on transitions from static states.

In a further aspect of the present invention, there is provided a liquid crystal display drive circuit such as a controller. Namely, a liquid crystal display drive circuit of the invention comprises: capacitance predicting means for predicting a capacitance value where each pixel will reach at one refresh cycle later when applying a predetermined voltage for targeted brightness; storage means for storing the predicted capacitance value; and voltage calculating means for calculating a voltage to be applied to each pixel based on targeted brightness at one refresh cycle later and the stored capacitance value.

It is noted that the overdrive voltage to be applied is calculated using the stored capacitance value as a parameter at a start point and using an input pixel value as a targeted brightness at one refresh cycle later. With this arrangement, an ideal overdrive is implemented compared with when using a previous pixel value or brightness, or predicted voltage or brightness as a parameter at a start point.

It is further noted that using a capacitance value as a parameter whose response time is faster than a brightness change, a brake effect for overshoot may be also expected.

In a further aspect of the present invention, there is provided a program for directing a computer to drive a liquid crystal display device, the program comprising the functions of: predicting a capacitance value where each pixel will reach at one refresh cycle later when applying a predetermined voltage to the liquid crystal display device based on the pixel value to be displayed; storing the predicted capacitance value in a buffer of the computer; and calculating a voltage to be applied to each pixel based on a pixel value to be displayed at one refresh cycle later and the stored capacitance value.

This program may be provided to a computer controlling a liquid crystal display from a remote program transmission apparatus via a network, for example. The program transmission apparatus may comprise storage means for storing a program such as a CD-ROM, DVD, memory, hard disk, etc., and transmission means for reading the program from the storage means and transmitting the program to an apparatus performing the program via a connector and a network such as the Internet or LAN. Alternatively, the program may be provided by means of a storage medium such as a CD-ROM.

Now the present invention will be described with reference to the accompanying drawings.

FIG. 1 is a schematic diagram of an embodiment of a liquid crystal display (LCD) device according to the present invention. As for the LCD device shown in FIG. 1, a liquid crystal module (LCD panel) is composed of a liquid crystal cell control circuit 1 and a liquid crystal cell 2 with a liquid crystal structure of thin film transistors (TFT). The liquid crystal module (hereinafter called LC module) is formed in a display device separated from a system unit on the host's side such as a personal computer (PC) or in the display part of a notebook computer. Namely, LCD device may be a standalone type of LCD connected to a host system via a line or an integrated type comprising both a host system and LCD. In a liquid crystal cell control circuit 1 shown in FIG. 1, RGB video data (i.e., video signals), control signals and DC power supply are input to an LCD controller 4 via a video interface (I/F) 3 from a graphics controller LSI (not shown) in the system. LC cell 2 may be a TFT liquid crystal of TN (twisted nematic) mode, for example.

DC-DC converter 5 generates a variety of DC power supply voltages necessary for liquid crystal cell control circuit 1 from DC power supply being supplied, and supplies them to a gate driver 6, a source driver 7 and a fluorescent tube (not shown) for backlight, etc. LCD controller 4 processes signals received from video I/F 3 and supplies processed signals to gate driver 6 and source driver 7. There exists an overdrive controller 10 between LCD controller 4 and source driver 7. Source driver 7 is responsible to supply a voltage to each of the source electrodes of TFTs arranged in a horizontal direction (X direction) in a TFT array, which is arranged in a matrix fashion on liquid crystal cells 2. Gate driver 6 is responsible to supply a voltage to each of the gate electrodes arranged in a vertical direction (Y direction) in a TFT array. Both gate driver 6 and source driver 7 are comprised of multiple ICs, wherein source driver 7 includes multiple source driver ICs 8 made of LSI chips, for example.

The maximum voltage rating of source driver 7 is typically 5V in TN mode for a notebook PC, wherein a 64 gray-level (6 bit) driver is used in notebook PCs without FRC (frame rate control) with consideration of the practical number of gray levels. On the other hand, an LCD monitor typically employs an IPS (in-plane switching, i.e., lateral electric field) mode, wherein a 256 gray-level (8 bit) driver with a maximum voltage rating of about 15V is used, however, substantially half that voltage, that is, about 7.5V is used by utilizing a dot inversion driving scheme. Source driver 7 for IPS can be used for TN liquid crystal (hereinafter TN-LC), wherein a high voltage greater than 5V is able to be used for overdrive. It is noted that in FRC (frame rate control), is added to the least significant bit over four frames in order to represent 8 bit gray scale using 6 bit driving, wherein the low order two bits are changed to be controlled according to time modulation. It is also noted that since FRC assumes that a PC screen is static, a different color may be appear when scrolling a thin line continuously, for example. It is undesirable to perform FRC for moving portions because the number of gray levels may be sacrificed.

A TFT-LCD comprising LC cell 2 has a response time slower than the display device such as a CRT. Note that a "response time" is defined as time required to reaching the absolute brightness precision (one-half or one-quater of the gray-level interval considering gamma characteristics) corresponding to a targeted gray level. The cause of slow response time includes a problem of the cumulative response and a problem resulting from that a liquid crystal is a viscous fluid, etc. Furthermore, the liquid crystal involves a problem of charge leak.

The cumulative response is mentioned as follows: a targeted gray level is not reached by only one charge or discharge, hence it is asymptotically approached as a result of accumulation of a voltage applied over multiple frames. At a pixel, liquid crystal is displaced with keeping charge Q at the end of selection in accordance with the inverse proportional curve CV=Q where C is capacitance and V is a voltage. Assuming that a voltage $V_{target}$ corresponding to a targeted gray level is applied to a pixel whose capacitance is $C_{start}$ at the start point, the charge after a selection will be $C_{start}V_{target}$, which is greater or smaller than the charge that is essentially required at the targeted gray level, i.e., $Q_{target}=C_{target}V_{target}$, by the ratio of $C_{start}/C_{target}$. Namely, this means that the targeted gray level can not be achieved as long as applying a static voltage corresponding to that targeted gray level. For a TFT-LCD, a targeted voltage is applied for each frame when displaying a static image, therefore, $C_{target}$ is approached in incremental or decremental steps in time sequence. The main cause of the slow response time of TN-LC in halftone levels, which is regarded as 16.7 ms response, is this cumulative response. This problem of cumulative response also applies to other liquid crystals other than TN-LC as long as the dielectric constant differs between ON state and OFF state.

Figure 2:
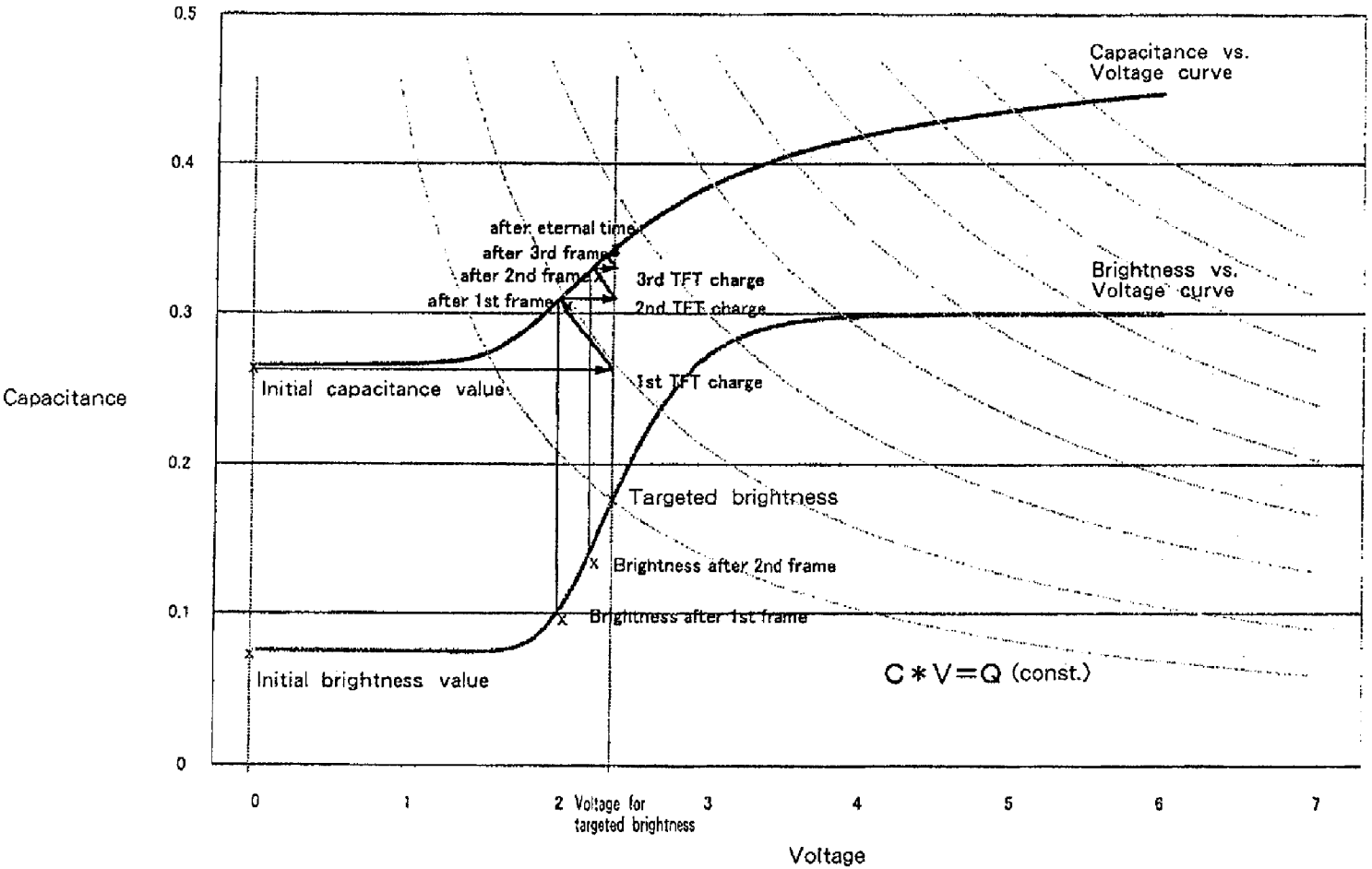
FIG. 2 is a diagram illustrating the characteristics of a liquid crystal where a targeted capacitance is reached in a zigzag move.

FIG. 2 is a diagram illustrating the characteristics of a liquid crystal where a targeted capacitance is reached in a zigzag move as described above. The horizontal axis represents voltage, while the vertical axis represents capacitance (electric capacity), wherein a brightness vs. voltage curve and a capacitance vs. voltage curve are depicted. When a first voltage corresponding to a targeted brightness is applied starting with the initial capacitance, the capacitance reaches the first position on the capacitance vs. voltage curve during one refresh cycle where a pixel is not selected, by moving along the inverse proportional line of CV=Q (Q is constant). Likewise, when applying a second and third voltage corresponding to the targeted brightness, it is seen that the brightness reaches the targeted brightness in incremental or decremental steps starting with the initial value.

By the way, since liquid crystal is a viscous fluid, its displacement speed is slow. For example, in TN mode, since liquid crystal molecules become disordered upon transition both in degrees of freedom $\Theta$ and $\phi$ in a three-dimensional space, the transition of brightness, which is affected by both $\Theta$ and $\phi$, delays compared to that of capacitance that represents the average state of $\Theta$. Namely, the brightness curve during the transition departs from that of a static state and strongly depends on a state at a start point. This delay can not be solved analytically, therefore, it must be obtained by simulation precisely. Now it is assumed that a slope of director vector with respect to a vertical direction in TN mode is $\Theta$, while a slope with respect to a horizontal direction is $\phi$. Also in IPS mode, it is assumed that a slope with respect to a direction perpendicular to the glass substrate is $\phi$, while a slope with respect to a horizontal direction is $\phi$.

Next, concerning a problem of charge leak, if there exists in liquid crystal a significant charge leak from a pixel within a frame period, a flicker phenomenon may occur while the same brightness is displayed statically. Furthermore, when a change in gray level occurs, the leak becomes the cause of delay for ON transition, while becoming the cause of acceleration for OFF transition except for full-OFF (white; 0 V). The charge leak depends on backlight brightness and inversion polarities as well as parasitic capacitance with data lines. The effect of leak can be incorporated into overdrive by adjusting Q, that is CV=Q (const.), by a leak amount. When a leak amount differs greatly depending on inversion polarities, the drive voltage can be changed depending on the inversion polarity even with a static display image by applying an overdrive mechanism just as it is, whereby the flicker is reduced.

In view of these problems, according to the present invention, there exists an overdrive controller 10 within a stream of pixel values from LCD controller 4, which passes to source driver 7 the pixel values overdriven to be modified. The term "overdrive" means here that an excessive voltage exceeding a targeted voltage is applied for a starting gray level compared with a voltage to be applied when displaying a targeted gray level, wherein the applied voltage may be excessive on a plus (+) direction or may be excessive on a minus (−) direction (i.e., toward 0 V).

Figure 3:
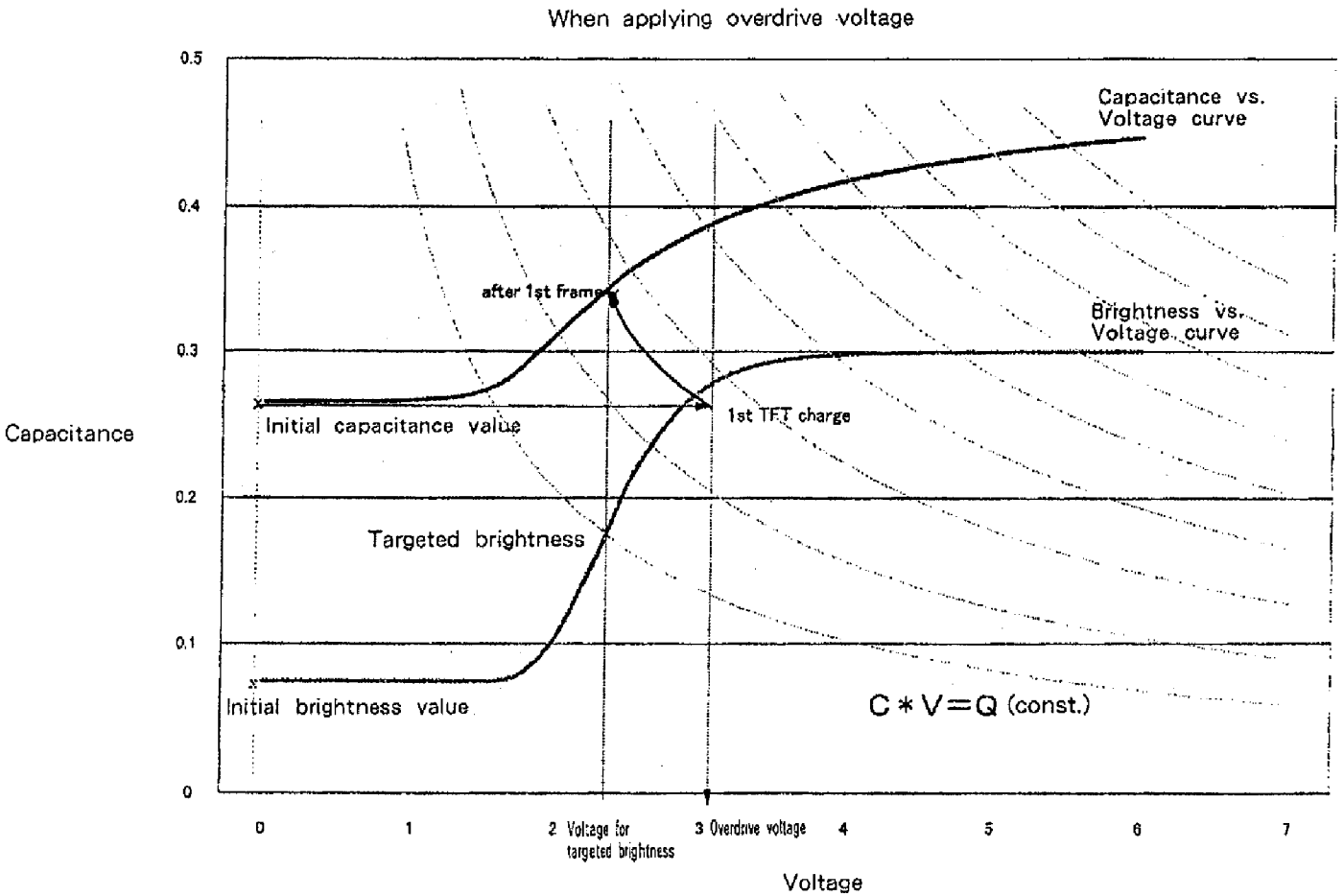
FIG. 3 is a diagram illustrating the characteristics of a liquid crystal when applying an overdrive voltage.

FIG. 3 is a diagram illustrating the characteristics of a liquid crystal when applying an overdrive voltage, which is applied to a first case of the most simple overdrive described below. As with FIG. 2, the horizontal axis represents voltage, while the vertical axis represents capacitance, wherein a brightness vs. voltage curve and a capacitance vs. voltage curve are depicted. In the drawing, there is shown the case where the excessive voltage is applied on the plus direction. Starting with an initial capacitance value, after an overdrive voltage is applied adding an excessive voltage to the voltage corresponding to the targeted brightness, the capacitance reaches the targeted position on the capacitance vs. voltage curve while the state moves along the inverse proportional line of CV=Q (Q is constant). As a result, the brightness reaches the targeted brightness on the brightness vs. voltage curve from its initial value. It is noted that the overdrive voltage depends on the state of a pixel liquid crystal at a staring point.

In order to implement the overdrive with good precision, it may be necessary to select source driver 7 with a greater number of gray levels than at present or to use a different voltage than at present in source driver 7. One can also consider that a pixel value input to overdrive controller 10 is a brightness value on which gamma correction has already been performed. Alternatively, the input value may be an index value represents gray level rather than the brightness value as is. The output pixel value is a voltage value to be applied to each pixel. If source driver 7 is a digital input type, the output value may be a value indicating a voltage.

Figure 4:
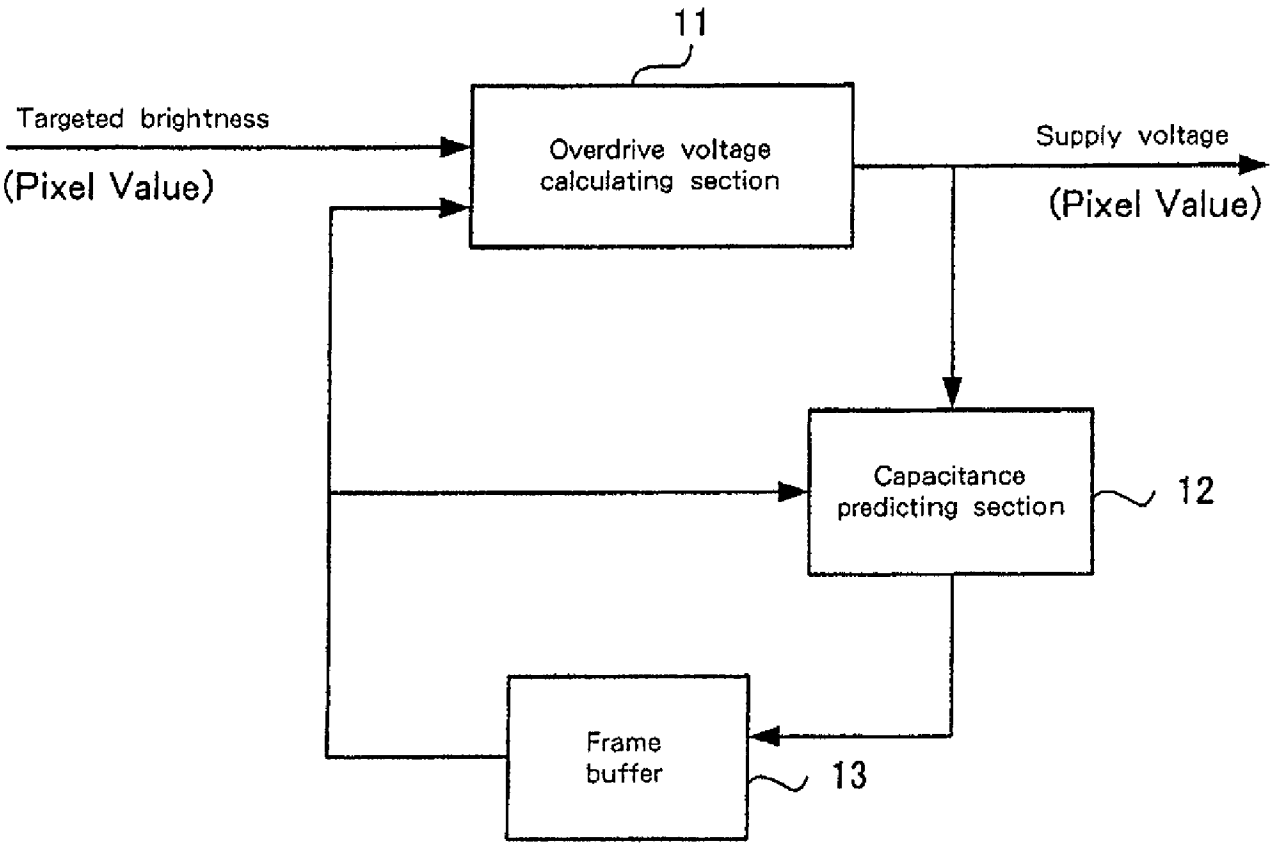
FIG. 4 is a diagram illustrating a configuration of an overdrive controller according to the invention.

FIG. 4 is a diagram illustrating a configuration of overdrive controller 10 according to the invention. It is herein constructed as a recursive system and comprises an overdrive voltage calculating section 11 for calculating an overdrive voltage to be applied to a pixel this time based on targeted brightness and a present capacitance value; capacitance predicting section 12 for predicting a capacitance value at one frame period later; and a frame buffer 13 for storing the capacitance value at one frame period later predicted by capacitance predicting section 12.

Figure 5:
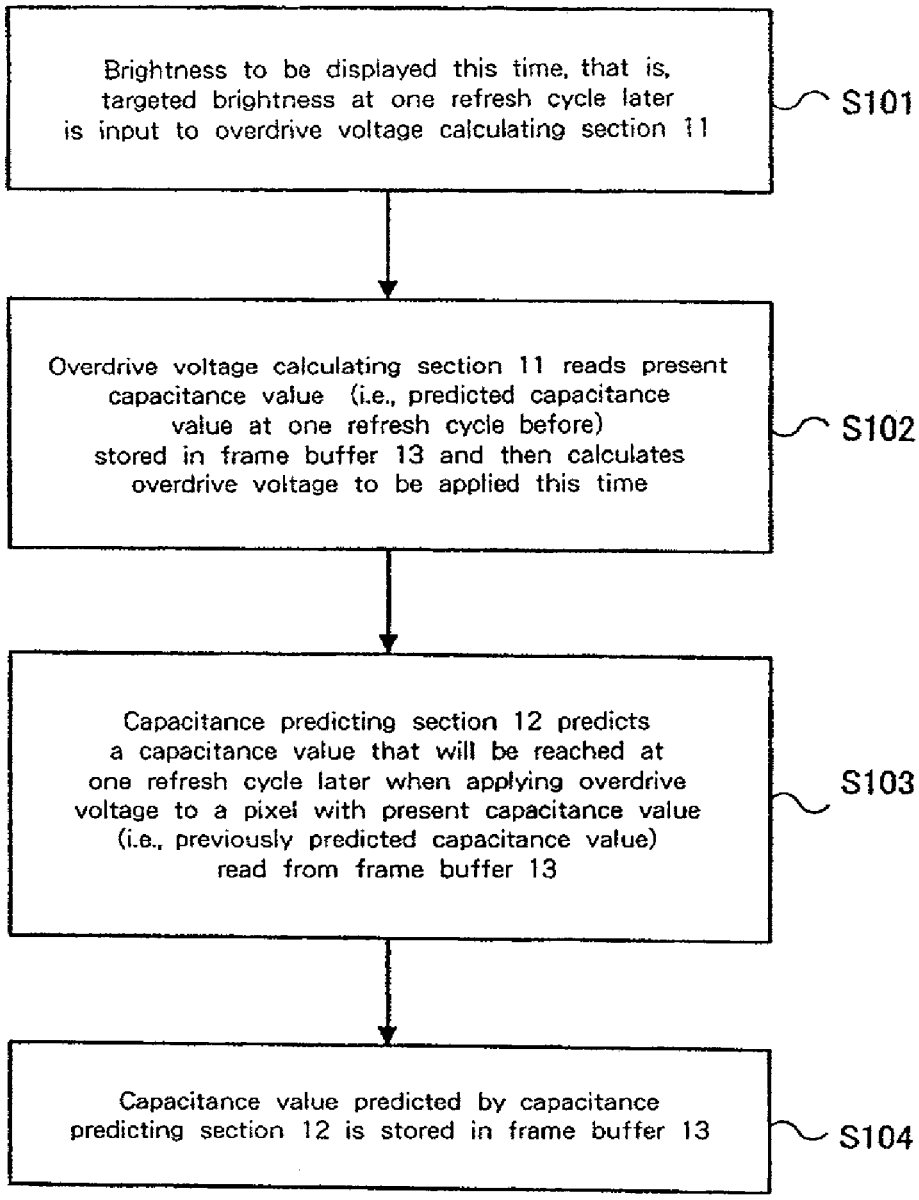
FIG. 5 is a flowchart illustrating the processing performed by the overdrive controller shown in FIG. 4.

FIG. 5 is a flowchart illustrating the processing performed by overdrive controller 10 shown in FIG. 4. First, the brightness to be displayed this time, that is, targeted brightness at one refresh cycle later is input to overdrive voltage calculating section 11 (step 101). Overdrive voltage calculating section 11 reads the present capacitance value (i.e., predicted capacitance value at one refresh cycle before) stored in frame buffer 13 and then calculates an overdrive voltage to be applied this time (step 102). Capacitance predicting section 12 predicts a capacitance value that will be reached at one refresh cycle later when the overdrive voltage is applied to a pixel with the present capacitance value (i.e., previously predicted capacitance value) read from frame buffer 13 (step 103). The capacitance value predicted by capacitance predicting section 12 is stored in frame buffer 13 (step 104). The capacitance value stored in frame buffer 13 is used by overdrive voltage calculating section 11 and capacitance predicting section 12 as a capacitance value of the present pixel at one refresh cycle later. In the embodiment of the present invention, it is characterized in that what is stored in frame buffer 13 is not the predicted voltage or brightness but the predicted capacitance value.

It may be possible to use a voltage region that isn't used as a static applied voltage as an applied voltage. For example, in a typical TN mode with 5V, the voltage regions that are not used as static voltage may be used, including 0V through 2V, 3V through 5V, and a voltage region higher than 5V (overvoltage region). It is noted that a "static voltage" means a voltage to be applied to a pixel in order to display its gray level in an equilibrium state (i.e., static state) where no change in gray levels occurs, wherein the brightness vs. voltage curve can be represented by a single curve such as a logistic curve as shown in FIGS. 2 and 3. In an overdrive scheme, a static voltage corresponding to gray level to be displayed is to be a targeted voltage to be reached.

FIG. 6 is a table associated with a TN mode liquid crystal with 5 μm gap and depicting values used to obtain an overdrive voltage to be applied this time based on the present capacitance value, which is obtained by the inventor's simulation. In the embodiment, this table is provided in overdrive voltage calculating section 11 and used as the reference data for interpolation. The values shown in FIG. 6 are unique parameters to that LCD and are stored in a specified nonvolatile memory (not shown) provided in overdrive controller 10. Shown in the second column is capacitance ($C_{LC}$) at a start point, while a targeted brightness is shown in the second row, wherein the targeted brightness is set for nine levels of gray scale, that is, level 0 (full-ON, i.e., black) through level 8 (full-OFF, i.e., white). The values shown in the table show the voltage to be applied. With regard to the capacitance, $C_{LC}$ is represented in the unit of pF/mm$^2$, however, in fact an absolute value of capacitance of the liquid crystal is not necessarily required, instead a relative value of all capacitance $C_{all}$ of a pixel may be used on the basis of a minimum capacitance $C_{LCmin}$ (i.e., OFF) of the liquid crystal.

In FIG. 6, there is shown the gray levels corresponding to the equilibrium state (static state) in the first column and the first row, respectively. In general, it is a rare case that the present capacitance corresponds to this gray level, so that an actual overdrive voltage is calculated using interpolation. A simple linear interpolation may generate nearly satisfying results. It is seen that in the table shown in FIG. 6, there are provided an extra portion in the first column that is described with voltage values ranging from 1.2V to 2.0V, which serves to perform interpolation around the threshold with a finer precision than nine gray levels.

FIG. 7 is a table used to calculate a capacitance value at one frame period later for a pixel with a certain capacitance value. More specifically, it is shown that what capacitance value a pixel reaches after 16.7 ms if applying a given voltage to the pixel with a given capacitance during a gate selection time (herein 21.7 μs for simulation). These information are provided and used in capacitance predicting section 12 shown in FIG. 4. The values shown in FIG. 7 are unique parameters to each LCD and are stored in a specified nonvolatile memory (not shown) provided in overdrive controller 10.

As for FIG. 7, just like FIG. 6, the first column shows the capacitance at a start point, while the first row shows the voltage to be applied, wherein the predicted capacitance values at 16.7 ms later are shown in the table. In general, it is a rare case that the present capacitance matches the capacitance shown in the first column, so that an actual calculation is performed using interpolation. As seen from the table, both the range of capacitance and the range of applied voltage go beyond the gray scale range defined in equilibrium.

The tables shown in FIGS. 6 and 7 are composed based on data that changes from an equilibrium state (static state). If using a parameter other than the capacitance as the one that represents the state at a start point, the values obtained based on a transition from a static state can not be used for a transition from a non-equilibrium state (dynamic state), accordingly the values in the table must be replaced depending on the history. However, according to the embodiment of the invention, the capacitance is used as a parameter at a start point, thus what is required is only one kind of table that is composed of transition data from a static state on the grounds described below.

In the above example, the capacitance varies from 5.5 to 13.5, thus frame buffer 13 may store the capacitance on the order of ten bits for each of RGB pixels. The number of bits has a tradeoff relationship with an overdrive precision. Moreover, since the sensitivity depending on a change in an initial value C is not linear, it is conceivable to compress the capacitance value into on the order of eight bits by mapping it in a nonlinear fashion.

Next, the calculation method according to the invention will be described in order, starting with the first case that is most simple up to the sixth case that uses a TN-LCD.

In the first case, there will be described a fast response liquid crystal wherein a transition from full-ON to full-OFF is performed much faster than one frame period (i.e., one refresh cycle). In this case, an amount that must be accelerated using the overdrive scheme corresponds to the decrease in value of C·V=Q (const.) that has been described relating to a cumulative response, therefore, the following voltage should be applied: $V_{apply}=V_{target}\cdot C_{target}/C_{present}$ The overvoltage region used is up to the following: $V_{apply}=V_{fullON}\cdot C_{fullON}/C_{fullOFF}$ If a transition of the liquid crystal is adequately fast both in ON direction and OFF direction and an internal state can approach thoroughly toward the equilibrium state within one frame period, a previous pixel value may be used as an index of $C_{present}$, wherein the system may be configured as a nonrecursive system with an ordinary frame buffer 13 serving as the first order delay. In this case, $V_{apply}$ will be calculated if there are prepared in tables as many entries of gray levels value vs. capacitance value relationship and entries of gray levels value vs. voltage relationship as the number of gray levels in a static state (equilibrium state).

In the second case, consider where a transition from full-ON to full-OFF is performed within one frame period in terms of brightness, however, the internal state does not reach the equilibrium state. Since $C_{present}$ value cannot be obtained in the nonrecursive system according to the first case, an error may occur in the overdrive in this nonrecursive system. Even with a TN-LC with 5 μm gap that is said to have a response time of less than 16 ms, it takes about 0.1 sec to 0.2 sec for the internal state to reach the equilibrium state under the threshold level (full-OFF, for example), so that about 6% to 20% error may occur if the capacitance at the point of 16.7 ms is used. Furthermore, referring to the capacitance vs. voltage curve of a TN-LC, it is seen that the brightness is saturated around a full-ON point (i.e., full black), while the capacitance has a slope. Even if the brightness has reached the full black within 16 ms, but the capacitance has not reached that of the full-ON state, its insufficient capacitance must be used for the next overdrive rather than the static capacitance corresponding to the full black level. If the static capacitance is continuously used as $C_{present}$, an error will be accumulated.

Namely, with regard to brightness, the following voltage should be used as an overdrive voltage: $V_{apply}=V_{target}\cdot C_{target}/C_{present}$ where $C_{present}$ must be estimated by any means. For that purpose, it is necessary to use a recursive system that estimates the capacitance at one frame period later based on $C_{present}$ and $V_{apply}$ rather than using the nonrecursive system, because Cpresent would take values other than those that are defined statically corresponding to gray levels. Attempting to construct a nonrecursive system, all of the histories of pixel values must be remembered so that infinite frame buffer 13 will be required.

In the third case, consider where, in some transitions of a same LC, the targeted brightness can not be reached within one frame period even with using the overdrive. Such examples may include, for example, a present TN-LC with 5 μm gap where a transition from full-ON to full-OFF takes time that is somewhat longer than one frame period in terms of brightness, or a present IPS-LC with 4 μm gap where a transition takes time for several frame periods. In this case, there exists an additional cause of delay resulting from a viscous fluid in addition to a cumulative response, the overdrive voltage is unable to be calculated using the above equation, i.e., $V_{apply}=V_{target}\cdot C_{target}/C_{present}$. So it is necessary to determine $V_{apply}$ using a table where the voltage necessary to reach the targeted gray level is listed and an internal state represented by some kind of parameter is set as a start point. Estimation of the parameter is to be performed using a recursive system just like the second case.

Estimation of the parameter at one frame period later and determination of the overdrive voltage is performed using the table as shown in FIG. 6 or FIG. 7 because the response to the voltage is nonlinear. The table is preferably composed of collection of discrete values, that is, coarsely to some extent, wherein the values in this table may be interpolated to calculate necessary values. Just like the present embodiment, it is most preferable to use the capacitance as a basic parameter. The reason is that the capacitance can be used as a unique parameter representing an internal state at one frame period later for a TN-LC, because the capacitance represents the sum of displacement of liquid crystal molecules in Θ as long as ϕ does not have a significant effect on the capacitance vs. brightness delay.

When using the voltage V that appears on the surface of the liquid crystal rather than the capacitance in order to represent the internal state, the voltage V may correspond to the capacitance in one-to-one relation in the equilibrium state (static state). However, during a transition, the present voltage $V_{present}$ is given by the following equation: $V_{present}=Q_{previous}/C_{present}$ where $V_{present}$ depends on the previous charge Q. As a result, the same voltage V corresponds to innumerable capacitance values (i.e., internal states). Namely, use of a voltage V that has a physical meaning can not determine the next start point for overdriving uniquely. Furthermore, for a transition where 0V is applied, Q becomes zero, so that the internal state can not be represented using the voltage V. In other words, when desiring to use the voltage V as a unique parameter indicating the internal state at a start point, it must be devised as some kind of hypothetical voltage rather than a physically substantial voltage V. If using the physical voltage V at that moment as a parameter, another auxiliary parameter needs to be used together with respect to information about previous charge Q or a transition associated with 0V. Therefore, it is preferable to use capacitance as a parameter just like the embodiment of the invention.

Now considering the fourth case, in a TN mode liquid crystal, there are two degrees of freedom Θ and ϕ, and it is not true that all molecules move orderly in unison, therefore, a displacement state of molecules during a transition and a displacement state in an equilibrium state are different even if they show the same brightness. The present inventor found that the change in capacitance during a transition precedes the change in brightness. Accordingly, if the overdrive is performed such that the brightness just reaches the targeted brightness at one frame period later, the capacitance will have gone past the static capacitance corresponding to the targeted gray level, while both capacitance and brightness will gradually converge in a state where the targeted gray level is outreached. This can not be suppressed even if applying the static voltage corresponding to the targeted gray level at the second frame, so that it takes several frame periods to return to the targeted brightness because this transient phenomenon corresponds to a transition associated with a small voltage difference. This transient phenomenon is called overshoot, which becomes bigger as a transition has a bigger gray scale difference.

Now let's consider the case where the brightness is specified as a parameter representing a state at a start point and the overdrive is applied such that the targeted brightness is reached at one frame period later. For the stepped change of gray level, though the static voltage is to be applied since the targeted brightness is reached at the start point of the next frame, this may lead the overshoot to continue for several frame periods. On the contrary, using the capacitance as a parameter that represents a state at a start point and performing the overdrive such that the targeted brightness is reached at one frame period later, the capacitance will have somewhat overreached the equilibrium value (static value), therefore, the turned overdrive will be selected for the next frame with respect to the stepped change of gray level. Namely, the similar effect is achieved equivalent to putting a brake on the overshoot, wherein the brightness could be quickly converged at the targeted brightness with vibrating.

Furthermore, it has been found from the simulation that if using capacitance as a start point parameter, the same voltage set as the overdrive voltage set that is used when starting from the equilibrium state may be used even when starting from the non-equilibrium state. This means that the relaxation time of $\Theta$ from the non-equilibrium state is short enough compared to one frame period considering that the capacitance is a parameter representative of $\Theta$, and that a delay of brightness relative to capacitance that is believed to be resulting from a deviation of $\phi$ from an equilibrium state will become nearly identical at one frame period later regardless of either starting from an equilibrium state or non-equilibrium state.

On the contrary, it has been found that when using brightness as a start point parameter and applying the overdrive voltage set for starting from the equilibrium state to that for starting point from the non-equilibrium state, an error of the reached brightness becomes large near the full white (i.e., near the threshold). It is believed that this results from the fact that the misfit between brightness and major state parameters such as capacitance becomes large near the threshold. In any event, it is an advantage that the calculation table for overdrive voltage only includes a single table as shown in FIG. 6 that starts from an equilibrium state, without the need to provide auxiliary parameters indicating whether a dynamic state or static state in the first order delay that stores internal states or without the need to provide delays in the second order or higher that represent histories so far as frame buffer 13.

Now the fifth case will be described. As stated above, it is preferable for overdriving to use a voltage region (overvoltage region, that is, more than 5V for TN-LC and more than 7.5V for IPS-LC) that is higher than full-ON essentially with a static voltage to solve the cumulative response. However, there may be a case where such a voltage can not be used due to a maximum voltage rating of source driver 7 or limitations of a power supply. In this case, it is necessary to estimate the state of the liquid crystal at one frame period later where the target will not be reached and make it the start point for the next overdrive, as described above with reference to the third case. For the recursive system in the second and third case described above, frame buffer 13 can be implemented with a single stage.

Finally, the sixth case will be described. Presently, as a source driver 7, a digital driver with 6 bit gray scale is used for a TN-LCD for notebook PCs and a digital driver with 8 bit gray scale is used for an IPS-LCD for monitors. However, for a typical TN mode LC, an intermediate gray level is defined within a narrow voltage range (latitude) between 2V to 3V except for full black and full white. In order to implement a preferred overdrive, it is desirable to generate an analog voltage over a whole voltage region, including 0V to 2V and 3V to 5V that are not used for definition of gray levels as well as a voltage region higher than 5V (overvoltage region). However, digital driver has a limit on the number of voltages it can generate, so that the number of voltages and the precision of overdrive are in a trade-off relationship. Nevertheless, it is possible to compensate and converge an error as long as overdrive controller 10 is composed as a recursive system.

As a reasonable implementation, source driver 7 may include source driver ICs 8 that have more gray levels than the static gray levels by one or two bits, thereby increasing the number of voltages twice or four times. Among those, one set is allocated to generate the original static gray levels, while the remainder are allocated to voltage regions such as 0V to 2V and 3V to 5V as well as a voltage region higher than 5V and further the coarse portion in terms of voltage setting within the latitude. Reflecting the sparseness of gray level setting according to a gamma curve, the sets of overdrive voltages are determined.

If desiring to implement the overdrive for whole gray levels without increasing the number of bits of source driver 7, some of the static gray level voltages set in the latitude are moved to voltage regions such as 0V to 2V and 3V to 5V as well as a voltage region higher than 5V. There may be a case where static voltages can not be applied to stationary pixels, however, the targeted brightness may be achieved by continuing vibration like FRC using the voltage above and below. This is also implemented using the overdrive based on the recursive system, however, it is more preferable to have auxiliary information indicative of execution of FRC for a pixel in the frame buffer in order to prevent problems such as flickering specific to FRC. Namely, as with the ordinary FRC, the timing of vibration may be shifted with respect to adjacent pixels to suppress flickering, wherein it is determined as to whether the timing should be moved or matched according to the auxiliary information.

As is estimated from the above example, the ordinary FRC is preferably performed using overdrive controller 10. If LCD controller 4 outputs gray scale values subjected to FRC, flickering may be emphasized by the overdrive, the overdrive should not be applied to these pixels. However, FRC is performed with high precision by overdrive controller 10 that has fine voltage allocations considering gamma characteristics rather than LCD controller 4 that applies FRC using the gray level values assumed to be linear. Furthermore, in the future, the resolution of gray scale of source driver 7 should be enhanced and made linear much more than at present and gamma characteristics should be provided using the digital values rather than the reference voltages. According to such a configuration, the overdrive will be able to provide an ideal analog voltage.

As mentioned above, according to the present invention, overdrive controller 10 applies an excessive voltage (i.e., overdrive voltage) exceeding a targeted pixel value such that the brightness of a pixel reaches the targeted value within one refresh cycle time. At this time, a feedback type of frame buffer 13 stores predicted capacitance at one refresh cycle later. Then based on the predicted capacitance, the overdrive voltage to be applied this time and the next predicted capacitance value are calculated. This allows that the targeted brightness is reached in a better state compared with the prior art. Furthermore, by reason of the prediction feedback, frame buffer 13 is composed of only a single stage, that is, the first order delay. Moreover, using capacitance value as a start point parameter, it becomes possible to put a brake on the overshoot that is generated by overdriving TN liquid crystal.

It is noted that in the embodiment of the invention, there is provided overdrive controller 10 between LCD controller 4 and source driver 7, wherein a response time of LCD is improved by overdrive controller 10, however, LCD controller 4 or source driver IC 8 may be responsible for it, or a host system may be responsible for it by performing software. In this case, the first order recursive system described above may be programmed and installed in a computer on the part of a host system.

As mentioned above, the present invention improves quality of scrolling of text, dragging of icons, or computer graphics (CG) animation displayed on LCDs, as well as reduces problems of color shifts, blurring and trailing that may appear on moving pictures displayed on LCDs.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

The invention claimed is:

1. A liquid crystal display device comprising:

a liquid crystal cell forming an image display area;

a driver applying a voltage to said liquid crystal cell; and an overdrive controller controlling said driver to apply an overdrive voltage that exceeds a targeted pixel value to said liquid crystal cell; wherein said overdrive controller predicts a capacitance value of a pixel at one frame period later when applying a predetermined voltage to the pixel with a certain capacitance value and stores the predicted capacitance value of each pixel and calculates said overdrive voltage based on the predicted capacitance value, wherein the predicted capacitance value accounts for dynamic changes in capacitance resulting from prior applications of voltages to said liquid crystal cell.

2. The liquid crystal display device according to claim 1, further comprising a memory storing information about a voltage value to be applied for a predetermined capacitance value, wherein said overdrive controller interpolates the information about the voltage value stored in said memory to calculate said overdrive voltage.

3. The liquid crystal display device according to claim 1, further comprising a memory storing information about a capacitance value of a pixel that will be reached at one frame period later when applying a predetermined voltage to the pixel with a certain capacitance value, wherein said overdrive controller interpolates the information about the capacitance value stored in said memory to calculate said predicted capacitance value.

4. The liquid crystal display device according to claim 1, wherein said liquid crystal cell has a nature where a brightness change delays compared with a capacitance change.

5. A liquid crystal display device comprising:

a liquid crystal cell displaying an image when a voltage is applied to each pixel having a TFT structure a driver applying a voltage to each pixel of said liquid crystal cell; and a controller controlling the driver to apply a voltage that exceeds an applied voltage to said liquid crystal cell when displaying targeted brightness on said liquid crystal cell, wherein said controller comprises voltage calculating means for calculating a voltage to be applied to said liquid crystal cell based on targeted brightness at one refresh cycle later corresponding to a pixel value to be displayed this time and a present capacitance value of the pixel that is predicted in advance, said controller further comprising:

capacitance predicting means for predicting a capacitance value of the pixel that will be reached after the refresh cycle when applying said voltage calculated by said voltage calculating means to the pixel with the present capacitance value, the predicted capacitance value accounting for dynamic changes in capacitance resulting from prior applications of voltages to said liquid crystal cell; and storage means for storing said capacitance value predicted by said capacitance predicting means, wherein the voltage calculating means calculates the voltage to be applied and the capacitance predicting means predicts the capacitance value, respectively, based on said capacitance value stored in said storage means.

6. The liquid crystal display device according to claim 5, further comprising a memory storing information used to obtain a voltage to be applied this time from a present capacitance value and information about a capacitance value where a pixel will reach when applying a predetermined voltage to the pixel with a predetermined capacitance value.

7. The liquid crystal display device according to claim 6, wherein the information stored in said memory and used to obtain said voltage and the information about said capacitance value are both discrete values obtained by simulation.

8. The liquid crystal display device according to claim 6, wherein the information stored in said memory and used to obtain said voltage and the information about said capacitance value are both values obtained based on a transition from a static state.

9. A liquid crystal display drive circuit comprising:

capacitance predicting means for predicting a capacitance value where each pixel will reach at one refresh cycle later when applying a predetermined voltage for targeted brightness, the predicted capacitance value accounting for dynamic changes in capacitance resulting from prior applications of voltages to said liquid crystal cell;

storage means for storing the predicted capacitance value; and voltage calculating means for calculating a voltage to be applied to each pixel based on targeted brightness at one refresh cycle later and the stored capacitance value.

10. The liquid crystal display drive circuit according to claim 9, wherein said capacitance predicting means reads predetermined information from a memory that stores information indicative of a capacitance value obtained at one refresh cycle later when applying a predetermined voltage to a pixel with a certain capacitance value, and interpolates the read information to predict the capacitance value.

11. The liquid crystal display drive circuit according to claim 9, wherein said voltage calculating means reads predetermined information from a memory that stores information for obtaining a voltage to be applied from certain capacitance value, and interpolates the read information based on said capacitance value stored in said storage means to calculate the voltage to be applied.

12. A method for driving a liquid crystal display, wherein an input pixel value is overdriven to output a modified pixel value, the method comprising the steps of:

predicting a capacitance value where each pixel will reach at one refresh cycle later when applying a predetermined voltage for the input pixel value, the predicted capacitance value accounting for dynamic changes in capacitance resulting from prior applications of voltages to said liquid crystal cell;

storing the predicted capacitance value; and calculating an overdrive voltage to be applied to each pixel based on an input pixel value at one refresh cycle later and the stored capacitance value.

13. The method according to claim 12, wherein the overdrive voltage to be applied is calculated using the stored capacitance value as a parameter at a start point and using an input pixel value as targeted brightness at one refresh cycle later.

14. A method for driving a liquid crystal display wherein a brightness change delays relative to a capacitance change, the method comprising the steps of:

predicting a capacitance value of each pixel of said liquid crystal display when applying a predetermined voltage, the predicted capacitance value accounting for dynamic changes in capacitance resulting from prior applications of voltages to said liquid crystal cell;

calculating a voltage exceeding the targeted pixel value based on an input targeted pixel value with using said predicted capacitance value as a parameter; and supplying a predetermined voltage to said liquid crystal display based on said calculated voltage.

15. A program for directing a computer to drive a liquid crystal display device, the program comprising the functions of:

predicting a capacitance value where each pixel will reach at one refresh cycle later when applying a predetermined voltage to the liquid crystal display device, the predicted capacitance value accounting for dynamic changes in capacitance resulting from prior applications of voltages to said liquid crystal cell;

storing the predicted capacitance value in a buffer of the computer; and calculating a voltage to be applied to each pixel based on a pixel value to be displayed at one refresh cycle later and the stored capacitance value.

16. The liquid crystal display device according to claim 1, wherein said overdrive controller implements a recursive system for estimating the capacitance at one frame period later based on said predetermined voltage to be applied and said certain capacitance value.

17. The method according to claim 12, wherein said predicting step includes implementing recursion for estimating the capacitance at one frame period later based on said predetermined voltage to be applied and a certain capacitance value.

18. The method according to claim 14, wherein said predicting step includes implementing recursion for estimating the capacitance at one frame period later based on said predetermined voltage to be applied and a certain capacitance value.

* * * * *